US007331357B2

(12) United States Patent
Huff

(10) Patent No.: US 7,331,357 B2
(45) Date of Patent: Feb. 19, 2008

(54) LEAK DIVERTER

(75) Inventor: Matthew J. Huff, Claysburg, PA (US)

(73) Assignee: New Pig Corporation, Tipton, PA (US)

( * ) Notice: Subject to any disclaimer, the term of this patent is extended or adjusted under 35 U.S.C. 154(b) by 0 days.

(21) Appl. No.: 11/490,562

(22) Filed: Jul. 21, 2006

(65) Prior Publication Data

US 2007/0039650 A1 Feb. 22, 2007

Related U.S. Application Data

(60) Provisional application No. 60/709,719, filed on Aug. 19, 2005.

(51) Int. Cl.
*E04D 13/00* (2006.01)

(52) U.S. Cl. ..... 137/312; 137/357; 222/108; 52/302.1

(58) Field of Classification Search ..... 137/312, 137/357; 222/108; 52/302.1
See application file for complete search history.

(56) References Cited

U.S. PATENT DOCUMENTS

| | | | | |
|---|---|---|---|---|
| 4,245,666 | A | 1/1981 | Norris | |
| 4,313,457 | A * | 2/1982 | Cliff | 137/312 |
| 4,633,899 | A | 1/1987 | Lord | |
| 5,008,652 | A | 4/1991 | Woloszyk | |
| 5,133,167 | A | 7/1992 | Drew et al. | |
| 5,172,718 | A | 12/1992 | Thornburgh | |
| 5,207,035 | A * | 5/1993 | Fowler | 52/22 |
| 5,299,591 | A | 4/1994 | Duncan | |
| 6,283,144 | B1 | 9/2001 | Kahn | |
| 6,622,750 | B1 | 9/2003 | Bergeron | |
| 6,640,502 | B2 | 11/2003 | Mueller | |
| 2003/0072886 | A1 | 4/2003 | Ito | |
| 2003/0159383 | A1 | 8/2003 | Mueller | |

* cited by examiner

*Primary Examiner*—Kevin Lee
(74) *Attorney, Agent, or Firm*—Matthew W. Gordon, Esq.; Alan G. Towner, Esq.; Pietragallo Bosick & Gordon, LLP

(57) ABSTRACT

A leak diverter for positioning above a suspended ceiling is disclosed. The leak diverter can comprise a liquid collection tray comprising a flexible or substantially rigid sheet of material. The leak diverter can have a drain in flow communication with the liquid collection tray. The leak diverter can comprise a perimeter frame and can be supported by a plurality of support members. The drain can be positioned to extend through either the liquid collection tray or the side barrier and can be positioned above the suspended ceiling. In one embodiment, the width of the leak diverter is less than the standard width of a suspended ceiling panel in order to facilitate installation of the diverter above the suspended ceiling. In another embodiment, the length of the leak diverter may be greater than the standard length or width of a suspended ceiling panel, and may straddle adjacent ceiling panels.

26 Claims, 6 Drawing Sheets

LEAK DIVERTER

CROSS-REFERENCE TO RELATED APPLICATION

This application claims the benefit of U.S. Provisional Patent Application Ser. No. 60/709,719 filed Aug. 19, 2005, which is incorporated herein by reference.

FIELD OF THE INVENTION

The present invention relates to leak diverters, and more particularly to leak diverters for positioning above suspended ceilings.

BACKGROUND OF THE INVENTION

Many commercial, public, and private buildings are constructed to include a suspended ceiling, also known as a drop ceiling. A suspended ceiling comprises an interconnected support grid and removable ceiling panels, such as acoustic tiles, positioned within the support grid. Support wires can be used to support the suspended ceiling from a structural building ceiling or roof. The tiles are typically 24×24 inches or 24×48 inches, however, other sized may also be used. The use of a suspended ceiling creates a functional hidden space between the structural ceiling, such as the underside of the roof or intermediate floors, and the suspended ceiling, which is observable from the interior of a room. This hidden space is often utilized for the installation of sprinkler systems, fire and smoke warning systems, computer networking, electrical cables and conduits, heating, ventilating and cooling (HVAC) systems, and/or water piping systems. Normal usage of the above-mentioned elements, as well as openings in the building roof, faulty plumbing and/or condensation that forms on piping and/or HVAC system components, can result in the formation of leaks. Without a leak diverting device, leaks can contact the ceiling panels causing structural damage, discoloration and/or unwanted moisture. In certain situations, leaks can pass through the ceiling panels and drip onto the contents of the room interior.

Previous attempts to confine leaks have included systems placed within the interior of the room and positioned underneath a leaking ceiling tile, such as floor mounted structures comprising a telescoping pole and a collection bag positioned along the underside of a ceiling panel. Other leak confinement systems have included ceiling tiles designed to collect leakage. Examples of such tiles are disclosed in U.S. Pat. Nos. 6,640,502 and 5,008,652. Although such designs may effectively handle many types of leaks, the tiles are visible from the interior of the room, must fit within the support grid, typically comprise visible hoses, and do not usually have the same appearance as conventional tiles or panels. Conventional deigns cannot be positioned along the perimeter of the ceiling, i.e. along cut ceiling tiles, and do not catch leaks that occur on the perimeter of the ceiling, such as leaks that occur above the grid itself.

There exists a need for a leak diverter that may be positioned above suspended ceilings that is inexpensive to produce, installs quickly, does not require a substantial retrofit to the existing suspended ceiling, and blends aesthetically with the occupied space below the suspended ceiling.

SUMMARY OF THE INVENTION

The present invention is a leak diverter that includes a liquid collection tray structured and arranged to rest above a suspended ceiling and a drain in flow communication with the liquid collection tray. The liquid collection tray can be supported by a perimeter frame and/or a plurality of support members. The liquid collection tray can also comprise a side barrier for confining liquid within the tray. A drain may be positioned to extend through either the bottom or side of the liquid collection tray. A drain hose is typically connected to the drain, however, it will be appreciated herein that the leak diverter of the present invention can be used without a drain hose.

It is an object of the present invention to provide a leak diverter for positioning above a suspended ceiling comprising a liquid collection tray structured and arranged to rest above the suspended ceiling, and a drain in flow communication with the liquid collection tray.

It is a further object of the present invention to provide a leak diverter for positioning above a suspended ceiling comprising a liquid collection tray and a drain in flow communication with the liquid collection tray, wherein the drain is structured and arranged to be positioned above the suspended ceiling.

A further objective of the present invention is to provide a leak diverting system comprising a suspended ceiling having an upper surface, and a leak diverter resting on the upper surface of the suspended ceiling.

It is yet a further objective of the present invention to provide a leak diverting system comprising a suspended ceiling, a liquid collection tray, and a drain in flow communication with liquid collection tray and positioned above the suspended ceiling.

These and other aspects of the present invention will be more apparent from the following description.

DETAILED DESCRIPTION

Figure 1:
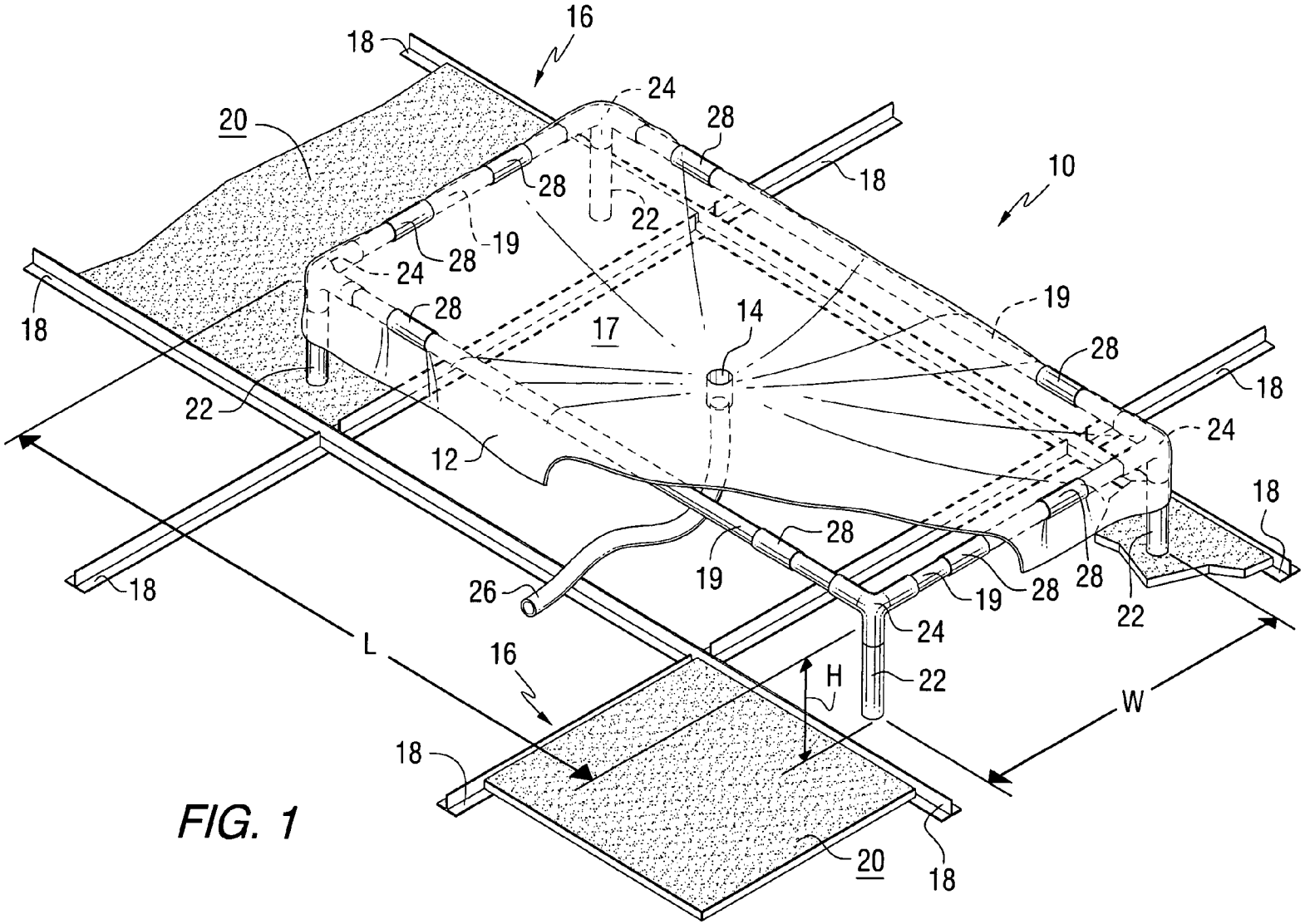
FIG. 1 is a perspective view of a leak diverter positioned above a suspended ceiling, having a flexible sheet liquid collection tray and a drain extending therethrough, in accordance with an embodiment of the present invention.

FIGS. 1-4 illustrate a leak diverter in accordance with an embodiment of the present invention. As shown in FIG. 1, the leak diverter 10 is structured and arranged to rest above a suspended ceiling 16. As used herein the term "suspended ceiling," means a ceiling installed below the structural ceiling or roof of a building and observable from inside the building. An example of a suspended ceiling is shown in FIG. 1 comprising an interlocking support grid 18 and removable ceiling panels 20, such as acoustic tiles, positionable within the support grid 18. The support grid 18 may be suspended from the structural ceiling and/or sidewalls of a building frame by support wires, and the support grid 18 can comprise a plurality of horizontal and/or vertical support bars, such as a plurality of horizontal and vertical support bars intersecting at right angles. The structural ceiling can comprise the substantially horizontal support system demarcating a story in a multiple story building, or the flat or angled interior of a building roof. The suspended ceiling 16 typically comprises a finished lower surface structured to face into a room interior and be visible to occupants of the room, and an upper surface which faces the structural ceiling. The leak diverter 10 of the present invention, is structured and arranged to rest above the suspended ceiling 16, i.e., on top of the upper surface of the ceiling panels 20 or support grid 18, or suspended from the structural ceiling, such as from support wires and/or metal trusses or pipes.

Figure 2:
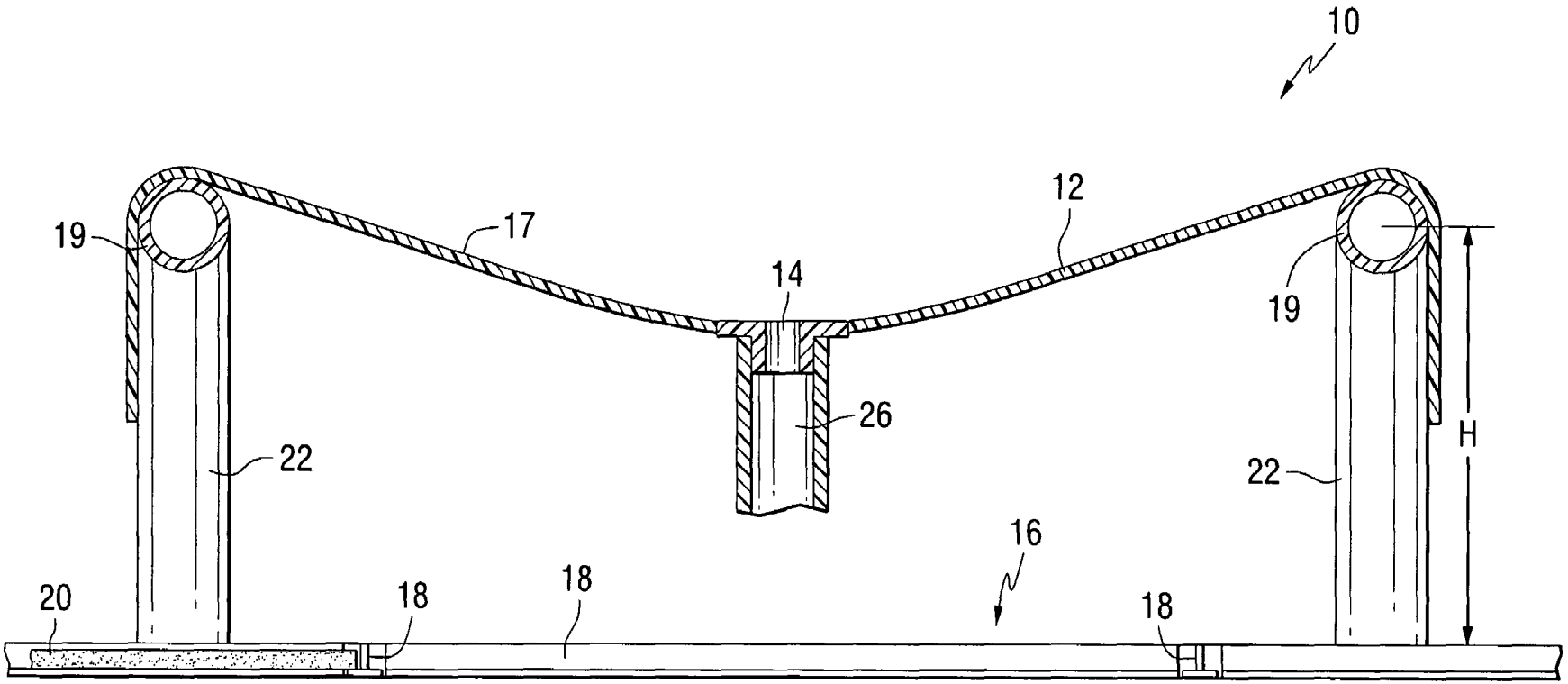
FIG. 2 is a side view of the leak diverter of FIG. 1.

Referring to FIGS. 1 and 2, the leak diverter 10 in accordance with an embodiment of the present invention comprises a liquid collection tray in the form of a flexible plastic sheet 12 and a drain 14 in fluid communication with the flexible sheet 12. As used herein, the term "liquid collection tray" means any suitable arrangement for collecting liquid, such as roof leaks, water leaking from piping and/or condensation and the like, which could otherwise fall onto the upper surface of the suspended ceiling 16. The liquid collection tray can comprise a rigid, semi-rigid and/or flexible sheet of material or preformed container. The flexible sheet and/or preformed container can comprise a polymeric material and/or a metal composition coated to prevent rust and/or corrosion. The liquid collection tray can comprise any suitable shape and size, such as a substantially square or rectangular shape. In one embodiment, the liquid collection tray may be sized differently than the size of a ceiling panel 20. For example, the liquid collection tray may be smaller in at least one dimension than the standard 24×24 inch or 24×48 inch ceiling panel, or may be larger in at least one dimension than such panels. Alternatively, the liquid collection tray may be sized to approximate the dimensions of a ceiling panel 20.

Still referring to FIGS. 1 and 2, the leak diverter 10 comprises a perimeter frame 19 which supports the flexible sheet 12 and a plurality of support members 22 structured and arranged to support at least a portion of the perimeter frame 19. The support members 22 are structured and arranged to rest on the upper surface of the suspended ceiling 16. In one embodiment, the support members 22 are structured and arranged to rest on one or more ceiling panels. In the embodiment shown in FIG. 1, the support members 22 are structured and arranged to rest on two ceiling panels which are separated by a central ceiling panel. In another embodiment, the support members 22 are structured and arranged to rest upon the support grid 18 of the suspended ceiling 16. In yet another embodiment, the support members 22 are structured and arranged to rest upon intersecting horizontal support bars of the support grid 18. The perimeter frame 19 can comprise any suitable material having sufficient strength to support the flexible sheet 12 when at least partially filled with a liquid. In one embodiment, the perimeter frame 19 comprises lightweight high-strength polymer, metal or wood tubing that can be integrally formed, or separately assembled.

The perimeter frame 19 can have any desired dimensions, such as sized to approximate the dimensions of a ceiling panel or to straddle adjacent panels. In one embodiment, the perimeter frame 19 can have a width W that is smaller than a standard opening within the support grid, e.g., smaller than 24 inches for standard 24×24 inch ceiling panels or 24×48 ceiling panels, in order to facilitate the installation of the leak diverter 10 through the support grid 18 an on to the suspended ceiling 16. In another embodiment, the perimeter frame 19 has a length L that is larger than a standard ceiling panel dimension, e.g., greater than 24 inches for a 24×24 inch ceiling panel, or greater than 48 inches for a 24×48 inch ceiling panel. For example, in one embodiment, the perimeter frame 19 can have a width W of about 20 inches and a length L of about 30 inches, and can straddle the grid separating at least two adjacent 24×24 inch ceiling panels. This size allows a user to install the perimeter frame 19 in an assembled position, through the support grid 18, e.g., which has a standard width of 24 inches.

As shown in FIG. 1, the support members 22 can comprise a plurality of integrally formed or attachable support posts, walls, legs, feet, flanges and the like. In one embodiment, the leak diverter 10 comprises a support member 22 engaged with a corner element 24 at each corner of the perimeter frame 19 of the flexible sheet 12. In one embodiment, the support posts have a height H of from about 1 inch to about 12 inches, such as from about 6 inches to about 12 inches.

Figure 3:
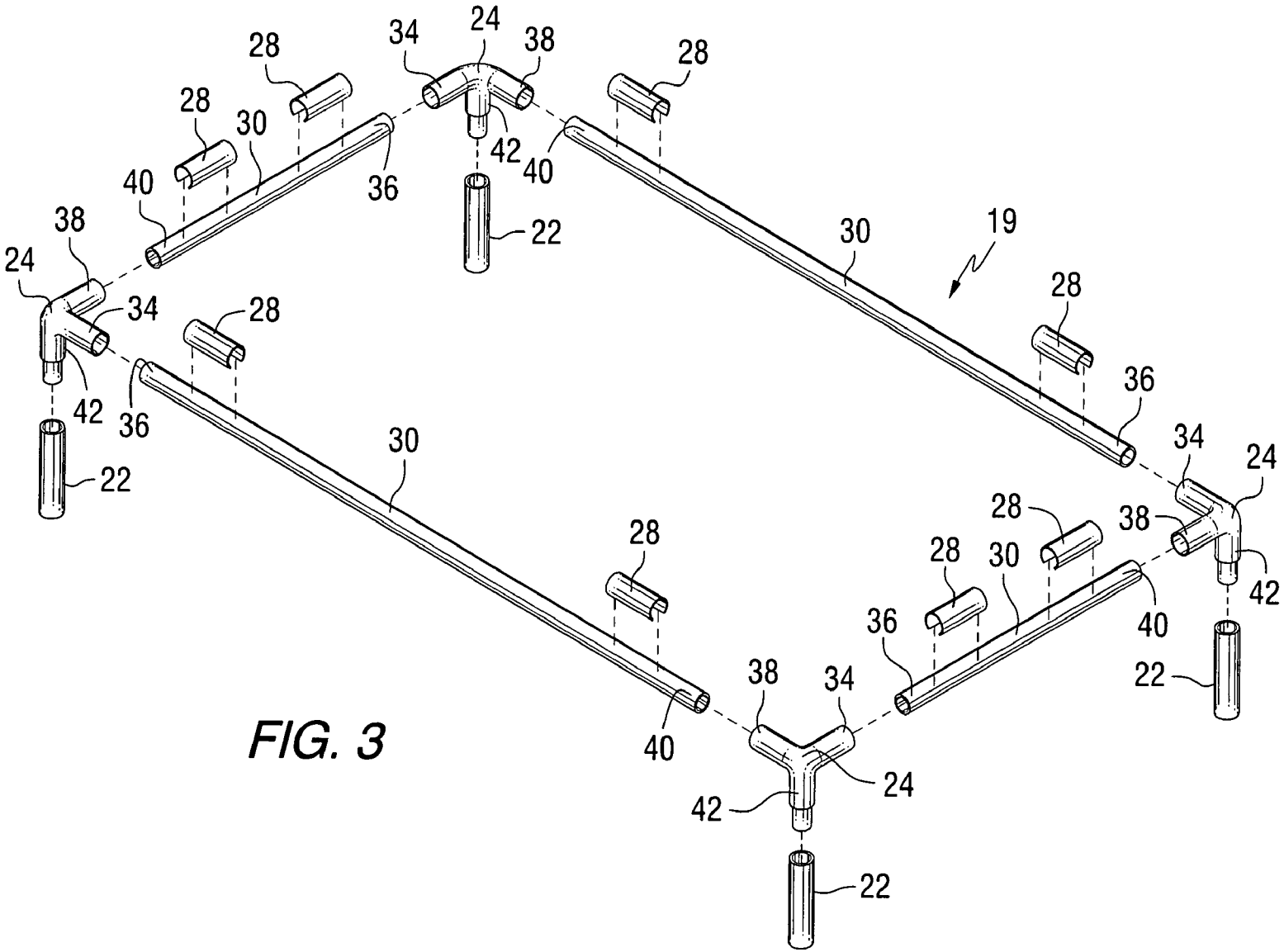
FIG. 3 is an exploded perspective view of the substantially horizontal perimeter bars, corner elements, and support members of a leak diverter in accordance with an embodiment of the present invention.

As shown in FIG. 3, the perimeter frame 19 can comprise multiple disassembled substantially horizontal perimeter bars 30 and multiple corner elements 24 which are capable of being assembled with the support members 22. The corner elements 24 can comprise a first end 34 for engaging a first perimeter bar end 36 of a substantially horizontal perimeter bar 30 and a second end 38 for engaging a second perimeter bar end 40 of a substantially horizontal perimeter bar 30. The corner elements 24 can also comprise a third end 42 for engaging a support member 22. The first end 34, the second end 38, and the third end 42, can be engageable with the first perimeter bar end 36, the second perimeter bar end 40 and a support member 22 respectively, by any suitable means, such as press-fit, snap means, screw means, and/or fastener means. The perimeter frame 19 can comprise a kit for assembly by a user or can be integrally formed.

Referring again to FIGS. 1 and 2, the flexible sheet 12 can comprise a top surface 17 that is sloped from the perimeter frame 19 toward the drain 14. In another embodiment, the top surface 17 of the flexible sheet 12 can be sloped from the perimeter frame 19 toward the drain 14 in more than one direction. The drain 14 can be positioned at any desirable location, such as at the center of the flexible sheet 12, at a corner of the flexible sheet 12, and/or along the perimeter frame 19 of the flexible sheet 12. In one embodiment, the flexible sheet 12 can comprise a plurality of drains 14. As shown in FIG. 1, the drain 14 can be positioned at substantially the center of the flexible sheet 12, and the top surface 17 can be sloped from each side of the perimeter frame 19 toward the drain 14. In another embodiment, a weight can be positioned in the flexible sheet 12 at about the drain 14. In this embodiment, the top surface 17 of the flexible sheet 12 is weighted near the drain 14 to allow liquid contacting the top surface 17 of the flexible sheet 12 to flow to the drain 14 without obstruction from other portions of the material comprising the flexible sheet 12. The drain 14 of the leak diverter 10 can be configured to extend through the flexible sheet 12. The drain 14 can comprise any suitable drain configuration, such as an open port, a flow-limiting valve, and/or a reinforced opening. In one embodiment, a drain hose 26 can be connected to the drain 14.

Referring to FIG. 1, the drain hose 26 can be positioned under the flexible sheet 12 of the leak diverter 10 and above the suspended ceiling 16. In one embodiment, the drain hose 26 can be connected to the drain 14 at a location between the flexible sheet 12 and the upper surface of the suspended ceiling 16, and rest on the upper surface of the suspended ceiling 16. The drain hose 26 can be hidden from view of occupants of the room space located below the suspended ceiling 16. The drain hose 26 can be connected to any suitable discharge system capable of removing collected liquid from the flexible sheet 12 and passing it to a removal area, such as a collection tank positioned above the suspended ceiling 16, or discharged to a drain integral to the building piping (not shown).

As shown in FIG. 1 (and in FIG. 3 in the unengaged position), a plurality of perimeter clamps 28 can be positioned over the perimeter frame 19 and the flexible sheet 12 to secure the material comprising the flexible sheet 12 to the perimeter frame 19. The flexible sheet 12 can be sized to extend beyond the dimensions of the perimeter frame 19 to allow the flexible sheet to overhang the perimeter frame 19. The perimeter clamps 28 can comprise any suitable material, such as a semi-rigid deformable polymeric material capable of accommodating the shape of the perimeter frame 19 and securing the flexible sheet 12 against the perimeter frame 19. The perimeter clamps 28 can comprise a generally C-shape tube or a tube having an opening slit running longitudinally along the tube. The perimeter clamps 28 can comprise a plurality of longitudinal grooves to further secure the flexible sheet 12 against the perimeter frame 19. In another embodiment, a pair of perimeter clamps 28 can be positioned at any location along a segment of the perimeter frame 19, such as adjacent the corner elements 24, to secure the flexible sheet 12 to the perimeter frame 19.

Figure 4:
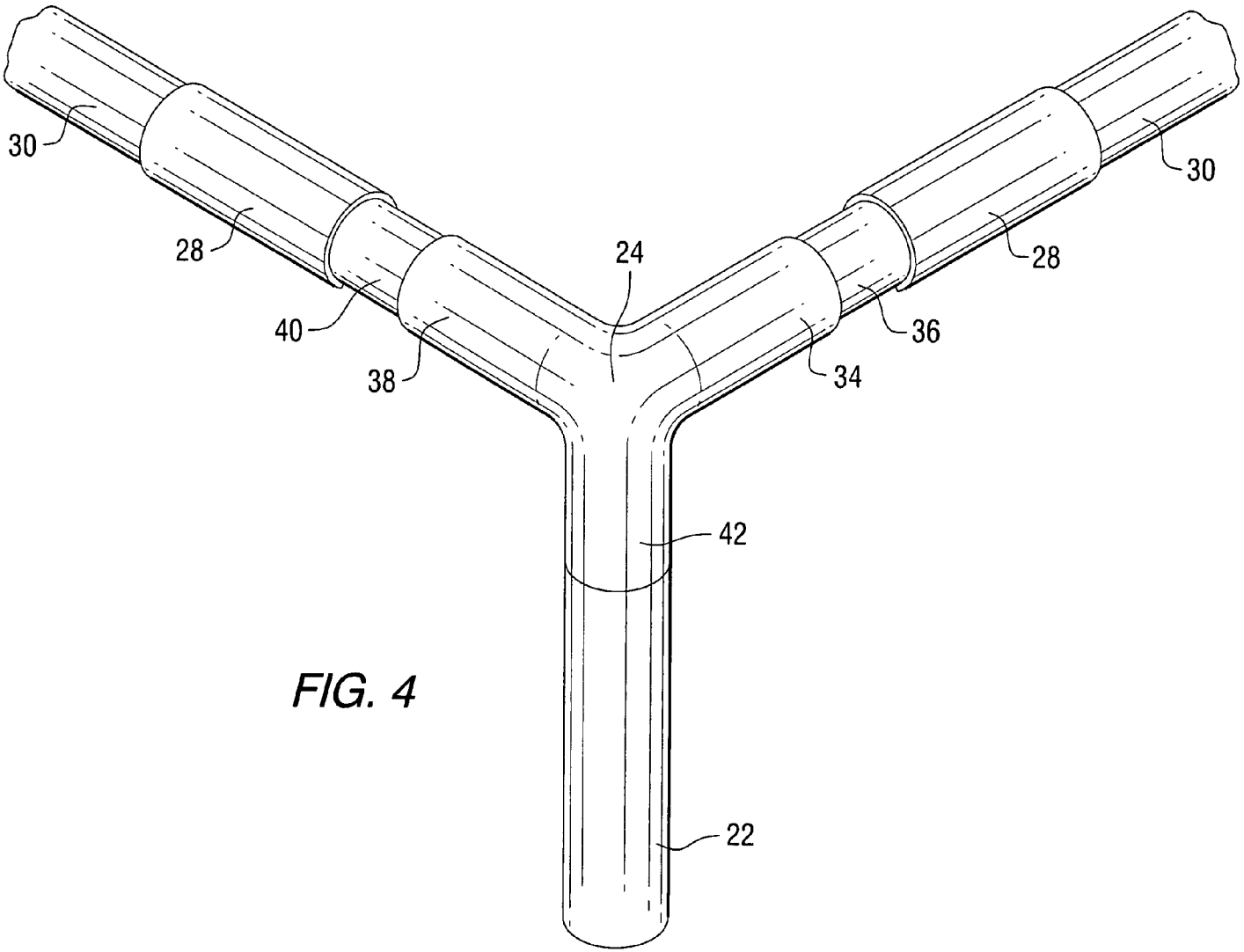
FIG. 4 is a perspective view of a portion of a leak diverter including an assembled corner element, two substantially horizontal perimeter bars, a support post, and two perimeter clamps in accordance with an embodiment of the present invention.

FIG. 4 shows a close-up view of a corner element 24 positioned at a corner of the leak diverter, having a first end 34 engaged with a first perimeter bar end 36 of a substantially horizontal perimeter bar 30 and a second end 38 engaged with a second perimeter bar end 40 of a substantially horizontal perimeter bar 30. Corner element 24 has a third end 42 engaged with a support member 22. A perimeter clamp 28 is secured to each substantially horizontal perimeter bar 30 of the perimeter frame. In one embodiment, a liquid collection tray (not shown) is disposed between the perimeter clamp 28 and the substantially horizontal perimeter bar 30 to secure the liquid collection tray to the perimeter frame.

In one embodiment, the liquid collection tray 12 of a first leak diverter 10, for example, as shown in FIG. 1, is sized to be larger than the perimeter frame 19 such that a portion of the liquid collection tray 12 can overlap the perimeter frame of a second leak diverter (not shown) positioned adjacent the first leak diverter 10. In this embodiment, the liquid collection tray 12 of the first leak diverter 10 may be structured for securement by any suitable means such as mechanical fasteners to the perimeter frame 19 of a second leak diverter to provide a larger area of coverage. For example, two or more leak diverters 10 as shown in FIG. 1 may be secured next to each other by overlapping the flexible sheet 12 of one leak diverter with the perimeter frame 19 of an adjacent leak diverter, and using the perimeter clamps 28 to secure the flexible sheet of the first diverter to the frame of the adjacent diverter. In this embodiment, a greater area of leak coverage can be obtained by joining two or more leak diverter units.

Figure 5:
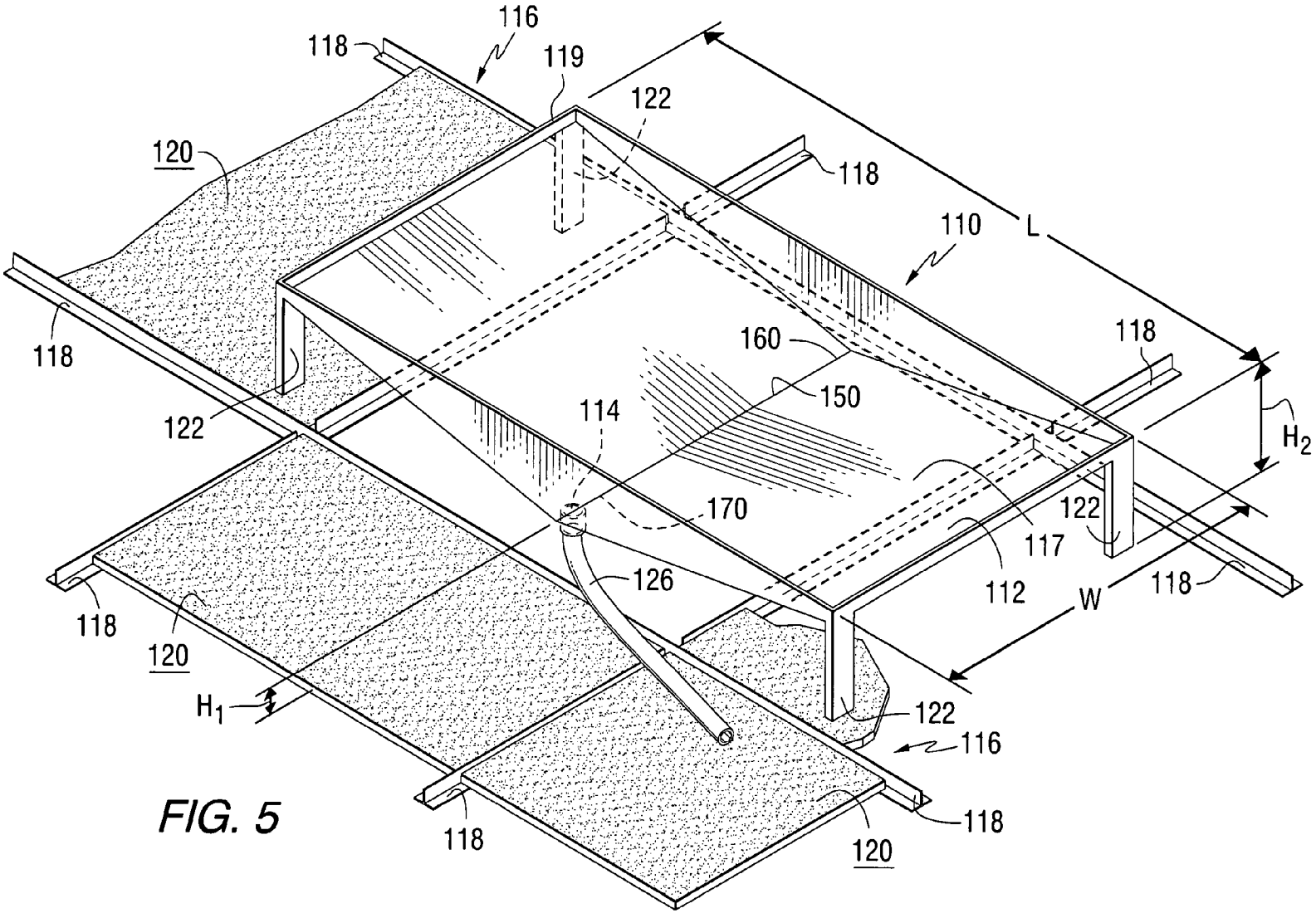
FIG. 5 is a perspective view of a leak diverter positioned above a suspended ceiling, having a rigid liquid collection tray that is sloped to an integrally formed drain in accordance with another embodiment of the present invention.

In an alternative embodiment, as shown in FIG. 5, the leak diverter 110 can comprise a liquid collection tray in the form of a rigid or semi-rigid container comprising a preformed material having a top surface 117 that is sloped toward a drain 114. As shown in FIG. 5, the leak diverter 110 is structured and arranged to rest on the upper surface of the suspended ceiling 116. The preformed liquid collection tray 112 can have a creased region 150 which has a height $H_1$, which is less than the height $H_2$ of the perimeter 119. In one embodiment, the height $H_1$ can be from about 0.5 inches to about 4 inches and the height $H_2$ can be from about the height $H_1$ plus about 0.5 inches to about 12 inches or more. The creased region 150 can be sloped from a first end 160 to a second end 170 adjacent the drain 114. The preformed liquid collection tray 112 can be supported at a plurality of locations along the perimeter 119 by a plurality of support members 122. In one embodiment, the support members 122 are structured and arranged to rest on the ceiling panels 120 of the suspended ceiling 116. In another embodiment, the support members 122 are structured and arranged to rest on the support grid 118 of the suspended ceiling 116. In another embodiment, a drain hose 126 can be connected to the drain 114. The drain hose 126 can be positioned under the preformed liquid collection tray 112 of the leak diverter 110 and above the suspended ceiling 116. In one embodiment, the drain hose 126 can be connected to the drain 114 at a location between a bottom side of the preformed liquid collection tray 112 and the upper surface of the suspended ceiling 116, and rest on the upper surface of the suspended ceiling 116.

Figure 6:
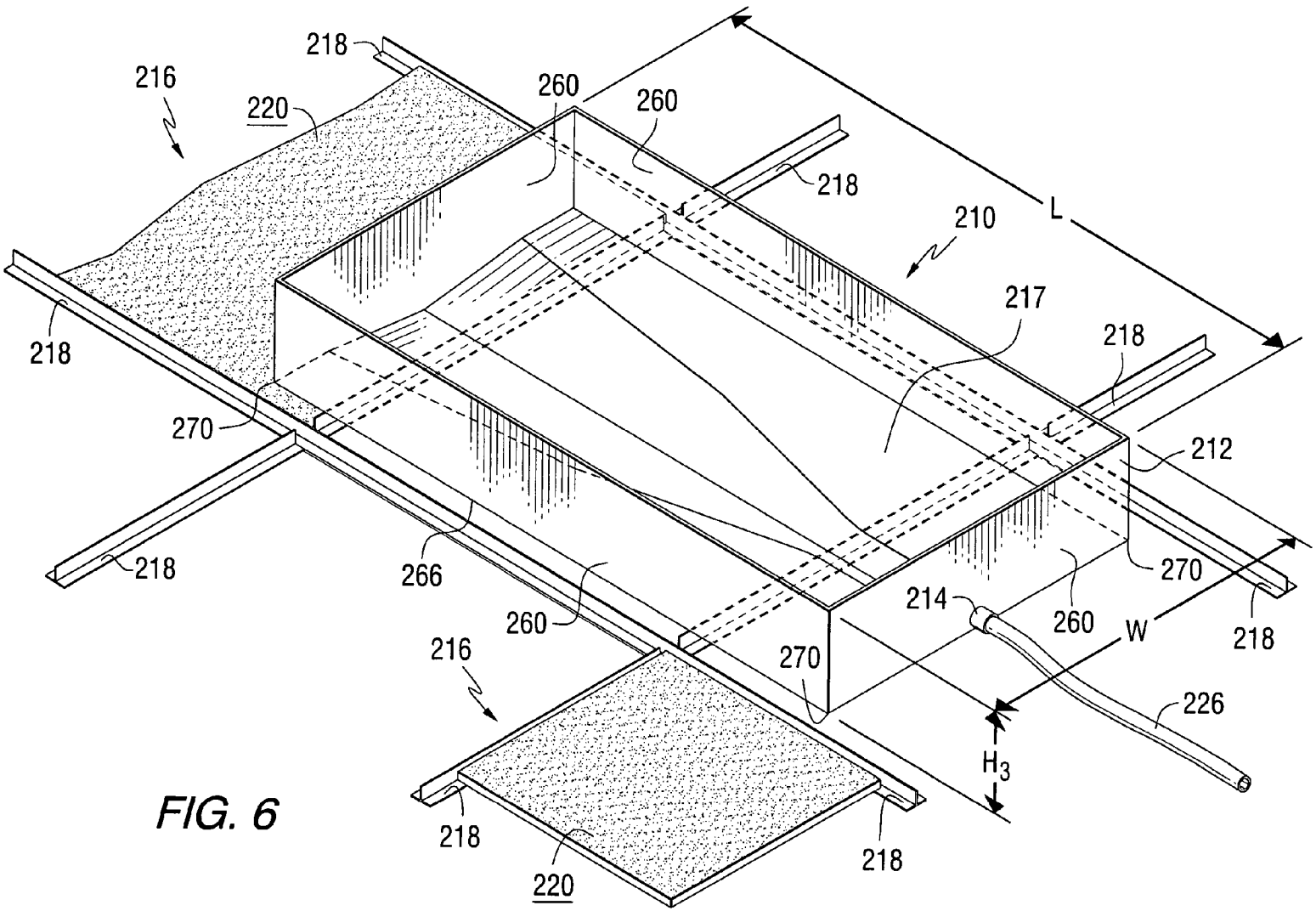
FIG. 6 is a perspective view of a leak diverter positioned above a suspended ceiling, comprising a rigid liquid collection tray having a sloped surface angled to an integrally formed drain within a side barrier in accordance with a further embodiment of the present invention.

In another alternative embodiment, as shown in FIG. 6, a leak diverter 210 can comprise a liquid collection tray in the form of a rigid or semi-rigid container comprising a preformed material having a top surface 217 that is sloped towards a drain 214. As shown in FIG. 6, the leak diverter 210 is structured and arranged to rest on the upper surface of the suspended ceiling 216. A bottom surface 266 of the preformed liquid collection tray 212 of the leak diverter 210 is structured to rest directly on the suspended ceiling 216. In the embodiment shown in FIG. 6, the bottom surface 266 rests on the support grid 218. In another embodiment, the corner regions 270 of the leak diverter 210 can be aligned to rest on the support grid 218 of the suspended ceiling 216.

As shown in FIG. 6, the preformed liquid collection tray 212 can comprise a plurality of side barriers 260 structured to extend vertically from the top surface 217 of the preformed liquid collection tray 212 to further contain any liquid contacting the top surface 217. In one embodiment, the side barriers 260 can have a height $H_3$ of any suitable dimension such as from about 1 inch to about 4 inches or greater. In another embodiment, the drain 214 is structured to extend through a side barrier 260. In yet another embodiment, the drain 214 can be connected to a drain hose 226 that is structured and arranged to rest on the upper surface of the suspended ceiling 216.

In any of the above-disclosed embodiments, a splash pad (not shown) made of any suitable material can be optionally placed in the interior of the leak diverter, such as on the top surface of the liquid collection tray, to limit splashing out of the leak diverter. The optional splash pad may be made of a substantially non-absorbent material that reduces splashing but allows the collected liquid to pass through to the drain of the leak diverter.

Whereas particular embodiments of this invention have been described above for purposes of illustration, it will be evident to those skilled in the art that numerous variations of the details of the present invention may be made without departing from the invention.

What is claimed is:

1. A leak diverter for positioning above a suspended ceiling comprising:

a liquid collection tray structured and arranged to rest above and to be supported by the suspended ceiling;

a drain in flow communication with the liquid collection tray; and a drain hose in flow communication with the drain and a liquid discharge system, wherein the drain and drain hose are above the suspended ceiling.

2. The leak diverter of claim 1, wherein the liquid collection tray comprises a flexible sheet of material.

3. The leak diverter of claim 1, wherein the liquid collection tray comprises a substantially rigid preformed material.

4. A leak diverter for positioning above a suspended ceiling comprising:

a liquid collection tray structured and arranged to rest above and to be supported by the suspended ceiling;

a drain in flow communication with the liquid collection tray; and a plurality of support members structured and arranged to support at least a portion of the liquid collection tray and rest on the suspended ceiling.

5. The leak diverter of claim 4, wherein the support members are structured and arranged to rest on at least two ceiling panels of the suspended ceiling.

6. The leak diverter of claim 4, having a width that is less than a width of a ceiling panel of the suspended ceiling.

7. The leak diverter of claim 4, having a length that is greater than a length of a ceiling panel of the suspended ceiling.

8. The leak diverter of claim 4 further comprising a drain hose connected to the drain.

9. The leak diverter of claim 4, wherein the liquid collection tray comprises a top surface sloped toward the drain.

10. A leak diverter for positioning above a suspended ceiling comprising:

a liquid collection tray structured and arranged to rest above and to be supported by the suspended ceiling;

a drain in flow communication with the liquid collection tray, wherein the liquid collection tray comprises a side barrier, wherein the drain extends through the side barrier.

11. A leak diverter for positioning above a suspended ceiling comprising:

a liquid collection tray structured and arranged to rest above and to be supported by the suspended ceiling;

a drain in flow communication with the liquid collection tray, wherein the liquid collection tray is supported by a perimeter frame, wherein at least one perimeter clamp secures the liquid collection tray to at least a portion of the perimeter frame.

12. The leak diverter of claim 11, wherein the liquid collection tray comprises a flexible sheet of material and the drain extends through the flexible sheet of material.

13. A leak diverter for positioning above a suspended ceiling comprising:

a liquid collection tray structured and arranged to be supported by the suspended ceiling;

a drain in flow communication with the liquid collection tray, wherein the drain is structured and arranged to be positioned above the suspended ceiling;

a plurality of support members structured and arranged to support the liquid collection tray and rest on the suspended ceiling.

14. The leak diverter of claim 13, further comprising a drain hose connected to the drain.

15. A leak diverter for positioning above a suspended ceiling comprising:

a liquid collection tray structured and arranged to be supported by the suspended ceiling; and a drain in flow communication with the liquid collection tray, wherein the drain is structured and arranged to be positioned above the suspended ceiling, wherein the leak diverter has a width that is less than a width of a ceiling panel of the suspended ceiling.

16. The leak diverter of claim 15, wherein the liquid collection tray comprises a flexible sheet of material and the drain extends through the flexible sheet of material.

17. A leak diverter for positioning above a suspended ceiling comprising:

a liquid collection tray structured and arranged to be supported by the suspended ceiling; and a drain in flow communication with the liquid collection tray, wherein the drain is structured and arranged to be positioned above the suspended ceiling, wherein the leak diverter has a length that is greater than a length of a ceiling panel of the suspended ceiling.

18. A leak diverter for positioning above a suspended ceiling comprising:

a liquid collection tray structured and arranged to be supported by the suspended ceiling; and a drain in flow communication with the liquid collection tray, wherein the drain is structured and arranged to be positioned above the suspended ceiling, wherein the liquid collection tray is supported by a perimeter frame, wherein at least one perimeter clamp secures the liquid collection tray to at least a portion of the perimeter frame.

19. A leak diverting system comprising:

a suspended ceiling having an upper surface; and a leak diverter resting on the upper surface of the suspended ceiling;

wherein the leak diverter has a width that is less than a width of a ceiling panel of the suspended ceiling.

20. The leak diverting system of claim 19, wherein the leak diverter comprises a liquid collection tray positioned above the suspended ceiling, and a drain in flow communication with the liquid collection tray.

21. The leak diverting system of claim 19, further comprising a drain in flow communication with the liquid collection tray, wherein the drain is structured and arranged to be positioned above the suspended ceiling.

22. The leak diverting system of claim 20, further comprising at least one other leak diverter positioned adjacent to the leak diverter.

23. A leak diverting system comprising:

a suspended ceiling having an upper surface; and a leak diverter resting on the upper surface of the suspended ceiling;

wherein the leak diverter has a length that is greater than a length of a ceiling panel of the suspended ceiling.

24. The leak diverting system of claim 23, wherein the leak diverter comprises a liquid collection tray positioned above the suspended ceiling, and a drain in flow communication with the liquid collection tray.

25. The leak diverting system of claim 23, further comprising a drain in flow communication with the liquid collection tray, wherein the drain is structured and arranged to be positioned above the suspended ceiling.

26. The leak diverting system of claim 23, further comprising at least one other leak diverter positioned adjacent to the leak diverter.

* * * * *